US011896108B2

(12) United States Patent
Seidler

(10) Patent No.: US 11,896,108 B2
(45) Date of Patent: Feb. 13, 2024

(54) MODULAR AND REFILLABLE CONTAINER DEVICE

(71) Applicant: Concept Workshop Worldwide, LLC, New York, NY (US)

(72) Inventor: Stewart Howard Seidler, Central (HK)

(73) Assignee: CONCEPT WORKSHOP WORLDWIDE, LLC, New York, NY (US)

( * ) Notice: Subject to any disclaimer, the term of this patent is extended or adjusted under 35 U.S.C. 154(b) by 298 days.

(21) Appl. No.: 17/100,821

(22) Filed: Nov. 21, 2020

(65) Prior Publication Data

US 2021/0153621 A1 May 27, 2021

Related U.S. Application Data

(60) Provisional application No. 62/938,366, filed on Nov. 21, 2019.

(51) Int. Cl.
*A45D 40/24* (2006.01)
*A45D 33/00* (2006.01)

(52) U.S. Cl.
CPC ..... *A45D 33/003* (2013.01); *A45D 40/24* (2013.01); *A45D 33/008* (2013.01)

(58) Field of Classification Search
CPC .. A45D 40/221; A45D 40/24; A45D 2203/00; A45D 33/003; B65D 43/18; B65D 2313/04; B65D 21/023
See application file for complete search history.

(56) References Cited

U.S. PATENT DOCUMENTS

| | | | | |
|---|---|---|---|---|
| 6,961,977 | B2 | 11/2005 | Seidler | |
| 7,055,216 | B2 | 6/2006 | Seidler | |
| 7,337,497 | B2 | 3/2008 | Seidler et al. | |
| 8,464,731 | B1 * | 6/2013 | Eberlein | A45D 40/221 132/301 |

FOREIGN PATENT DOCUMENTS

| | | | |
|---|---|---|---|
| KR | 200455160 | Y1 * | 8/2011 |
| KR | 20120003778 | U * | 6/2012 |
| KR | 102089282 | B1 * | 11/2019 |

* cited by examiner

*Primary Examiner* — Mollie Impink
(74) *Attorney, Agent, or Firm* — CARTER, DELUCA & FARRELL LLP

(57) ABSTRACT

The present disclosure relates to refillable, modular containers consisting of a disposable refillable section and a retained section. The refillable section is dislodged from the retained section by pressing a release button which separates the two parts. Proximal to the releasing section is a connectable hinging mechanism by which individual modular containers can be connected and rotated about the hinge.

7 Claims, 16 Drawing Sheets

MODULAR AND REFILLABLE CONTAINER DEVICE

CROSS-REFERENCE TO RELATED APPLICATIONS

The present application claims priority to, and the benefit of, U.S. Provisional Application No. 62/938,366, filed Nov. 21, 2019, which is hereby incorporated by reference in its entirety.

FIELD OF THE TECHNOLOGY

The present disclosure relates generally to containers and, more particularly, to containers having refillable and modular features.

BACKGROUND

There is enormous pressure to develop new packaging systems that result is a reduced ecological footprint and still provide similar benefits of current packaging. This constitutes the first motivation for developing this invention. Many packaging containers can be divided into two parts. The first part is the part that protects the product and carry various tools and accessories that allow the consumer to use the product or, compliment use of the product. This part is reusable and as the name suggests, the part that the consumer does not need to throw away when the product is used up. The second part is the holder of the product itself. The holder's primary function is to be the packaging that is in direct contact with the product.

There is enormous pressure to develop new packaging systems that result is a reduced ecological footprint and still provide similar benefits of current packaging. This constitutes the first motivation for developing this invention. Many packaging containers can be divided into two parts. The first part is the part that protects the product and carry various tools and accessories that allow the consumer to use the product or, compliment use of the product. This part is reusable and as the name suggests, the part that the consumer does not need to throw away when the product is used up. The second part is the holder of the product itself. The holder's primary function is to be the packaging that is in direct contact with the product.

For example, a cosmetic makeup compact is typically made up of an outer casing made of plastic, metal, and/or sometimes rubber materials. The outer casing is designed to protect the product, hold accessories such as brushes and mirrors, and provide a brandable design consisting of expensive decoration and product ingredient information. A company will invest considerable cost in developing and manufacturing this outer casing and, disposing this part is expensive and environmentally wasteful.

Within the outer casing are one or more metal or plastic pans that hold the makeup product. Once the product is fully used, the holder can't be readily reused as it is contaminated with residue from the old product. The amount of material and cost in making this portion of the container is minimal and is often made of ecofriendly materials. This pan can, if the package is suitably designed, be thrown away. But the process of removing this pan holder is messy and inconvenient. Generally, to remove the pan, the user must dig the pan out of a surrounding well and reinstall new pan without contaminating the new product.

It would be advantageous to be able to easily and cleanly remove this reusable holder from the outer container and replace it with a new reusable holder. It is preferable that removal of the holder is simple to understand and, can be accomplished with minimal effort and without mess. Replacement with a new product holder should be similarly convenient.

Another motivation for developing this invention is the fact that many consumers desire packaging that allows them more flexibility in choosing and transporting products without cumbersome package containers. There is an expanding market for innovative customizable packaging that utilize modular design concepts. There are modular containers on the market that allow the consumer to attach individual container modules to each other and assemble an overall product container that holds multiple items. Some of these containers allow the consumer to even open them without completely detaching the module. Instead, the user can temporarily expose the product for use by either rotating the modules about coaxial magnetic axes. Such containers allow the user to connect the modules by magnetic or mechanical means. But the problem here is that the packaging can be expensive and, if the package contains magnets, disposing the package could harm the environment.

For example, there are several devices on the market that use magnets to hold the individual cosmetic modules together. They typically use neodymium magnets. Each module contains one or more magnets with north and south poles facing outward so that they can connect with another magnetic module. For there to be sufficient attractive force between the magnets, the manufacturer must use powerful but, expensive magnets. So, there is a benefit being able to reuse parts of the package that contain the magnets and only replace the product.

SUMMARY

The invention described below would allow the manufacturer to incorporate the magnet into the reusable part of the container and snap a non-reusable product-filled holder into the container. When the user finishes the product, they could push a button-like protrusion attached to the reusable part of the container and throw away only the ecofriendly part of the container; then replace the latter with a new container with the product refill.

The button described above also serves as the connector between two or more containers. The connection can be accomplished magnetically whereby similarly oriented magnets embedded near or within the connector. Or the connection can be accomplished by a male-female snap mechanism formed by an extension of the button protrusion described above.

Furthermore, the connectors described can serve as hinges whereby the user can rotate one container about the other container thus exposing the product and allow it to be accessed. The rotation occurs about the common magnetic axis of the similarly oriented magnets. Or the rotation can occur about the axis formed by the button protrusion of one container as it extends into a corresponding hole beneath the second container.

This invention teaches methods to be incorporated into the design of a product container that offers an environmentally friendly, cost effective, and modular package.

Though the above introduction focused on describing a device where the cover rotates relative to a base, there are designs that describe multiple base structures that similarly rotate relative to one another. Furthermore, though the current embodiment is a cosmetic compact, the disclosed technology can be used to package other products including pills, ointments, small items such as screws and dental components, and food products such as spices.

BRIEF DESCRIPTION OF THE FIGURES

A better understanding of the features and advantages of the disclosed technology will be obtained by reference to the following detailed description that sets forth illustrative embodiments, in which the principles of the technology are utilized, and the accompanying drawings of which.

DETAILED DESCRIPTION

The present disclosure relates to containers having refillable parts. The disclosed containers have cover and product-containing base components, or a pair of base components, and allow a user to open the container and access the product within.

As used herein, the term "protrusion" refers to a structure that protrudes from a surface. The structure may protrude directly from the surface or may protrude from the surface via an intermediate structure. A term "protrusion" shall refer to any such structure of any shape. As certain shapes may appear to have multiple protrusions, the term "protrusion" may be used interchangeably with the term "protrusions."

As used herein, the term "hole" refers to a space within a surface. The space may extend directly from the surface or may extend from the surface via an intermediate space. A term "hole" shall refer to any such space of any shape.

Figure 1:
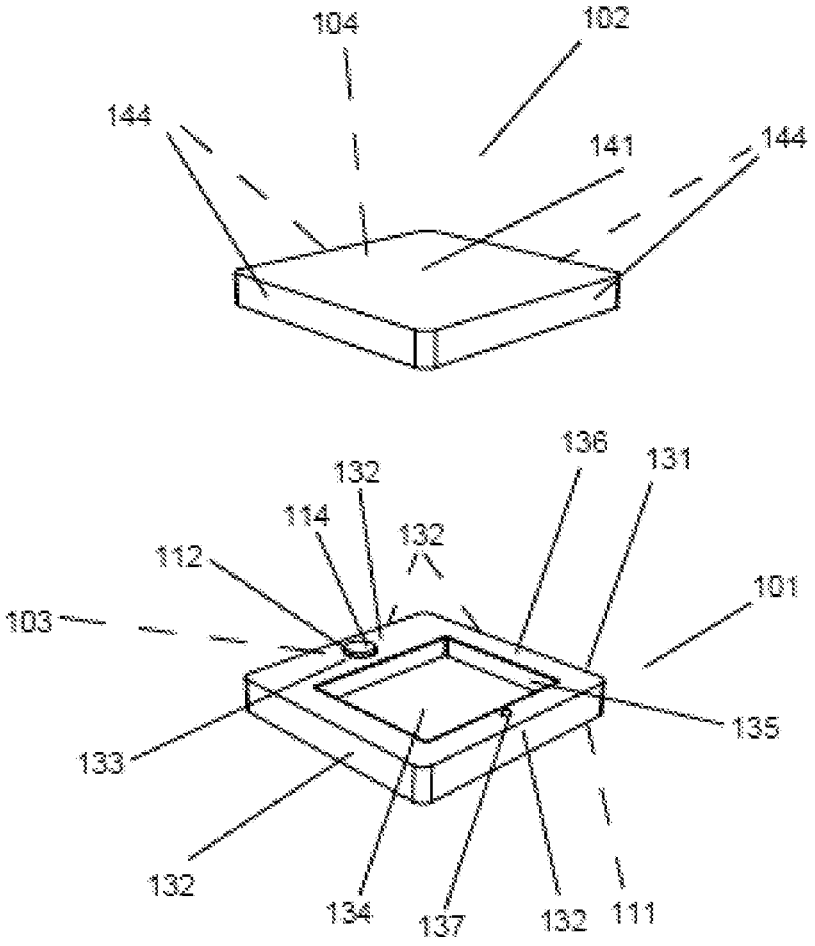
FIG. 1 shows the cover and base of the exemplary magnetic version of the refillable container viewed from above.

FIG. 1 shows an exemplary cosmetic refillable container device viewed obliquely from above. The cover 102 consists of a cover top surface 141 and is surrounded by cover side walls 144. Proximal to one of the cover side walls is embedded a cover magnet 104. The base 101 is composed of an upper base 131 and a lower base 111. As will be explained later, the upper base and the lower base are detachable from one another. The upper base has an upper base top surface 136 and is surrounded by upper base side walls 132. There is an upper base product well 134 which is surrounded by upper base product well walls 135, into which would be inserted a product. There is an upper base buttonhole 133, through which is accessible a button 112. The button is attached to the lower base. In the exemplary drawing, the button extends above the surface. Below the button is a base magnet 103. An upper base protrusion 137 is positioned on the upper base top surface to engage with a corresponding base indent 117 or cover indent 146 as shown in FIG. 2.

Figure 2:
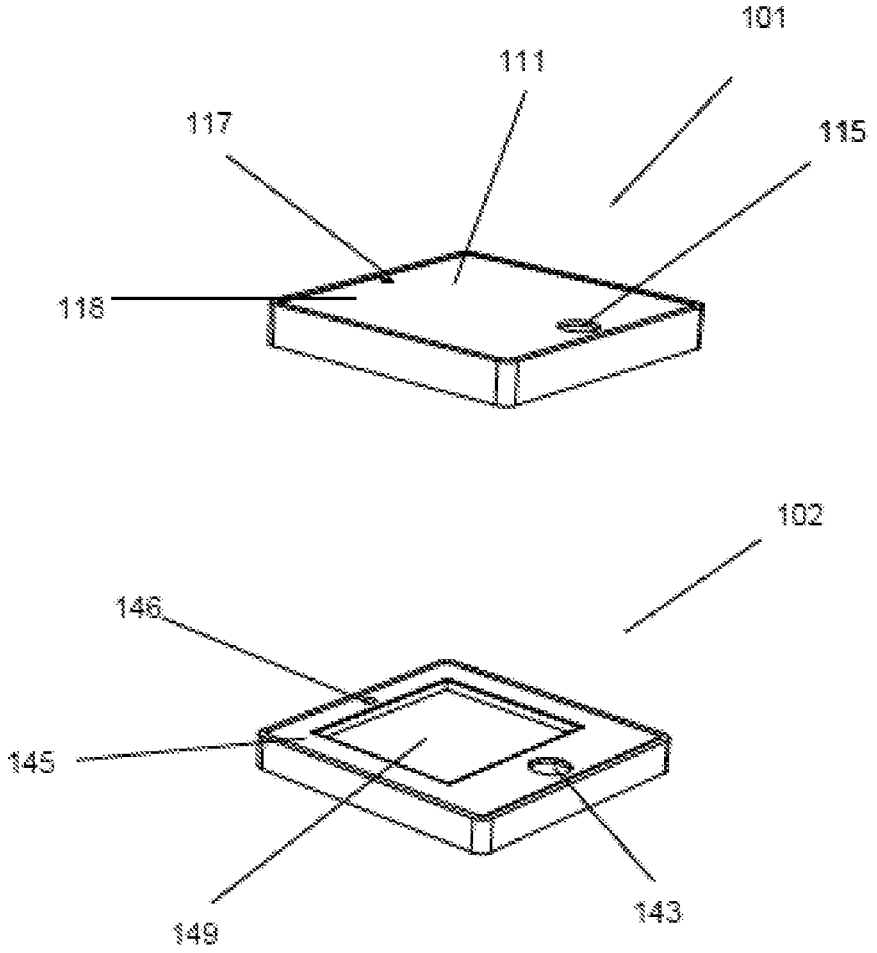
FIG. 2 shows the cover and base of the magnetic version of the container viewed from below.

FIG. 2 shows a bottom oblique view of the cover 102 and base 101 described in FIG. 1. On the bottom of the cover 102 is a cover bottom surface 145. Within this surface is a mirror well, into which can be placed a mirror. On one side of the cover is a cover button inset 143 When the cover and the base are in a closed position, the inset is sufficiently large that it can engage with the button 112 shown in FIG. 1. There is a lower base bottom surface 118, into which is embedded a base button inset 115. When the base and a second base are in a closed position, this inset is sufficiently large so that it can engage with the button 112 shown in FIG. 1. The lower base indent 117 and the cover indent 146 are positioned to correspond with the upper base protrusion 137 shown in FIG. 1. The functions of these indents will be discussed in FIGS. 8*a*-*c*.

Figure 3:
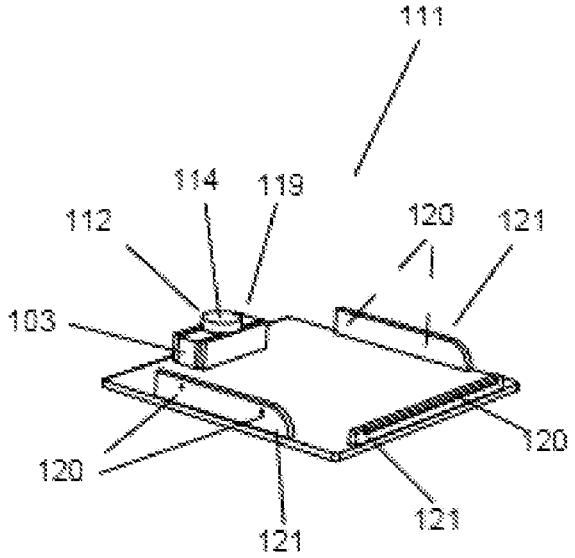
FIG. 3 shows the top view of the exemplary lower portion of the base.

FIG. 3 shows the top view of the lower base 111. On one side is the base magnet 103 set within a lower base magnet area 119. Attached over lower base magnet area is a button 112 with a button top surface 114. There is one or more lower base stabilizers 121 whose height is designed such that it fits within the base when it is fully attached to the upper base 131 as described in FIGS. 1 and 2. Attached to the lower base stabilizers are one or more lower base snap components 120 whose function will be detailed later.

Figure 4:
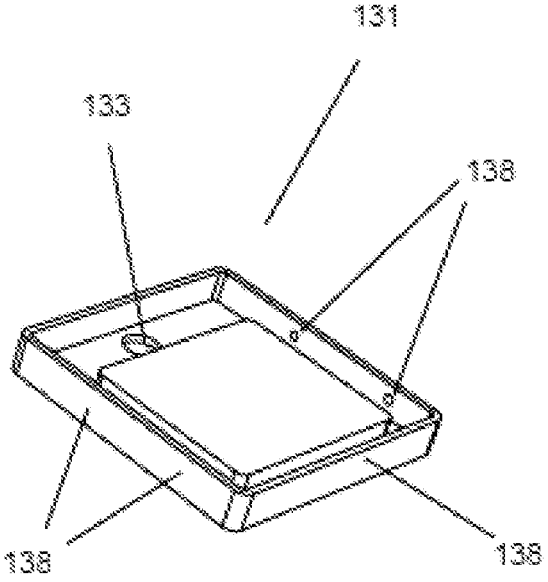
FIG. 4 shows the bottom view of a exemplary upper portion of the base.

FIG. 4 shows the bottom view of upper base 131 described in FIG. 1. The upper base buttonhole 133 is positioned and sized such that the button 112 of FIG. 1 can extend through it when the upper base is fully attached to the lower base 111 shown in FIG. 3. There are also one or more upper base snap components 138 positioned and sized so that they may engage with the corresponding lower base snap components 120 described in FIG. 3, when the upper base is fully attached to the lower base. The upper base and the lower base are dimensioned such that the latter fits into the former when the base is completely attached together.

Figure 5C:
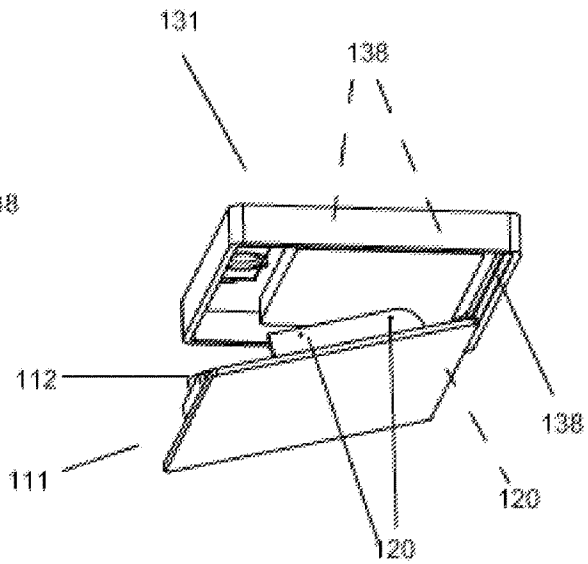
FIGS. 5*a*-5*c* illustrates how the lower portion of the magnetic base is disengaged from the upper portion of the magnetic base.
Figure 5B:
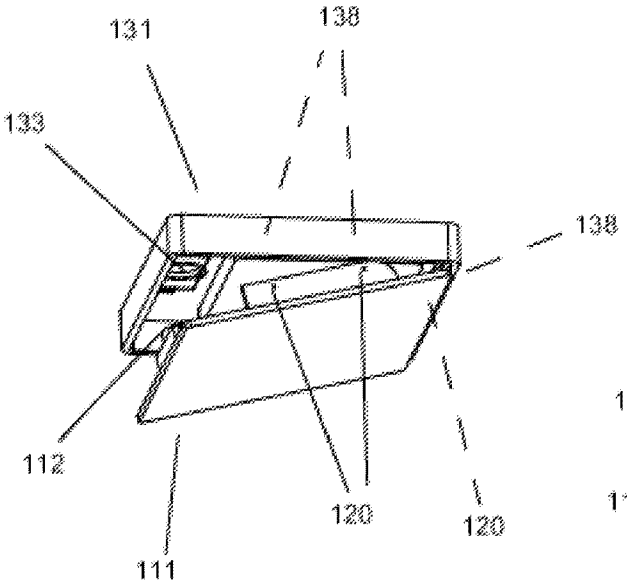
Figure 5A:
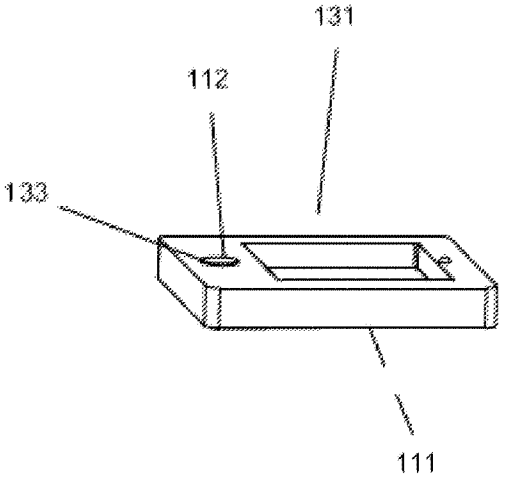

FIGS. 5*a*-*b* sequentially illustrate how the lower base 111 is disconnected from the upper base 131. In 5*a*, the upper base and lower base are fully attached by a method which will be detailed in FIG. 7. The exemplary illustration shows the button 112 protruding through the upper base buttonhole 133. FIG. 5*b* shows how the button 112 of the lower base is pushed through the upper base buttonhole 113 in the upper base. The lower base snap components 120 and upper base snap components 138 are dislodged. FIG. 5*c* shows the lower and upper bases completely separated. The lower base snap components 120 and upper base snap components 138 are visible.

Figure 6A:
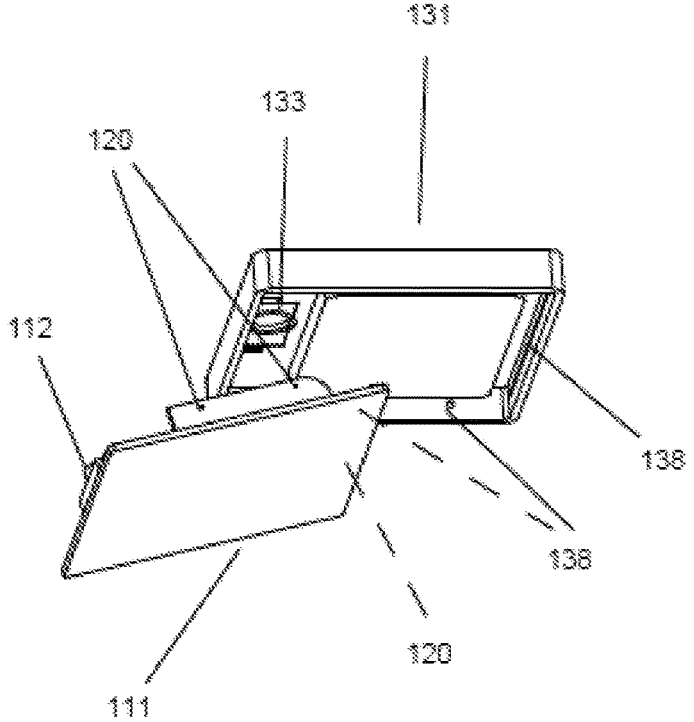
FIGS. 6*a*-6*b* show how the lower portion of the base is reattached to the upper portion of the base.
Figure 6B:
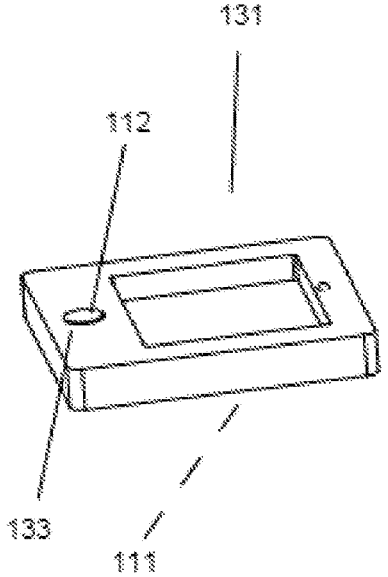

FIGS. 6*a*-*b* sequentially show how the lower base 111 is reattached to the upper base 131. The lower base is inserted through the bottom of the upper base as shown in FIG. 6*a*. The button 112 of the lower base is then pushed into the upper base buttonhole 133 and snapped closed by engagement between the upper base snap components 138 and lower base snap components 120. FIG. 6*b* shows the assembled base.

Figure 7A:
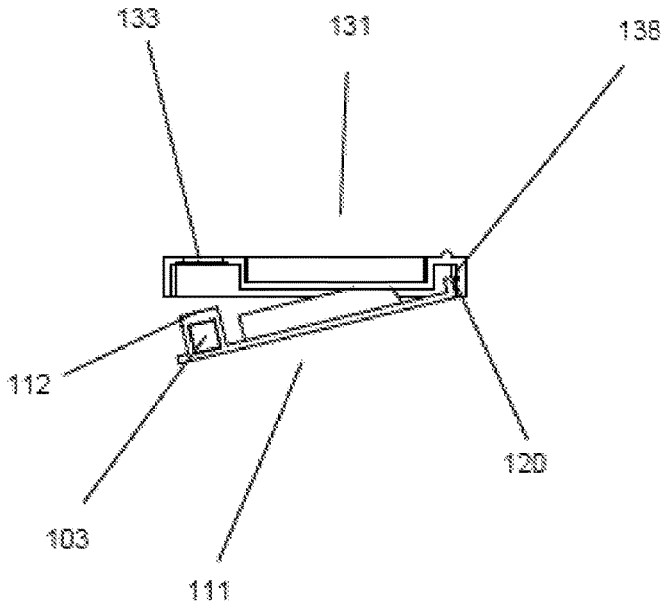
FIGS. 7*a*-7*b* shows a cross section exemplary detailed interaction between the upper and lower base snap components.
Figure 7B:
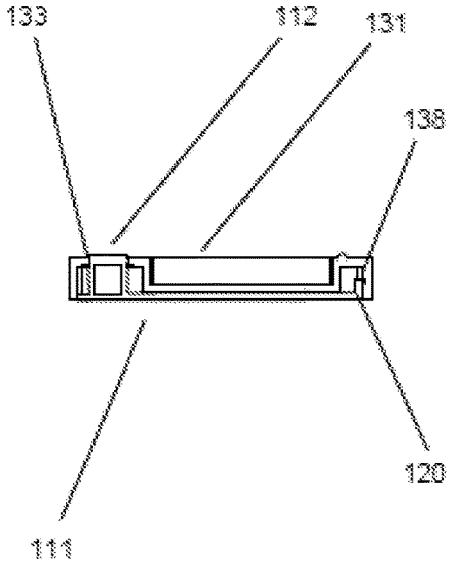

FIGS. 7*a-b* show a cross section of the exemplary detailed interaction between the upper and lower base snap components. Illustrated are the upper base 131 and lower base 111. FIG. 7*a* illustrates how the lower base snap component 120 is about to engage with an upper base snap component 138. The button 112 is approximately located below the upper base buttonhole 133 but, has not yet engaged with the hole. Beneath the button is the base magnet 103. FIG. 6*b* shows the assembled base.

In the device represented by FIGS. 1-7, the product is contained in the upper base product well. When the product is used up, the user would disconnect it from the lower base as described above, dispose the upper base with the depleted product, retain the lower base with the expensive and non-ecofriendly base magnet, and then replenish the container with a new upper base containing fresh product.

The snap components described represent only one possible configuration of the upper and lower base snap components. Complimentary snap components can be positioned at many different possible locations within the upper and lower base. The device will function properly as long as they are aligned such that they may engage with each other and, allow the button and upper base buttonhole to properly align and engage with one another. Snap components may also be located on the button 212 as it engages with the upper base buttonhole 233. This is described in FIGS. 14-21.

Also, the product well could be located in the lower base as is described later in FIG. 22. Another design would be to design the lower base to contain the product. In this case, the upper base would contain the base magnet and the button would be connected to the upper base and face downwards so that it is accessible through a buttonhole built into the lower base bottom surface. In such a design, the button might only partially penetrate the buttonhole.

The lower and upper base snap components can be disconnected after the user pushes the button and pushes the connected upper base away from the lower base. In this case the lower base, containing the product, would be disposed, and replaced with a new lower base. The magnet would be retained in the upper base and be reused.

Figure 8:
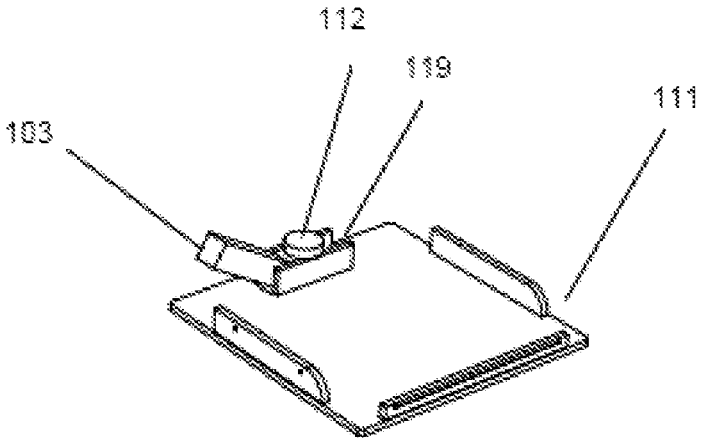
FIG. 8 shows how the magnet can be removed from the lower portion of the base.

FIG. 8 shows how the magnet can be removed from the lower base 111. The lower base magnet area 119 that is built into the lower base, contains a base magnet 103. This magnet is shown being removed from an opening at the side of the lower base magnet area. This figure illustrates one of many methods by which the magnet may be removed. It can be removed from the front, bottom, or opposite side of the base. The magnet can then be recycled, reused, or sent back to the manufacturer as part of a recycling program.

Figure 9C:
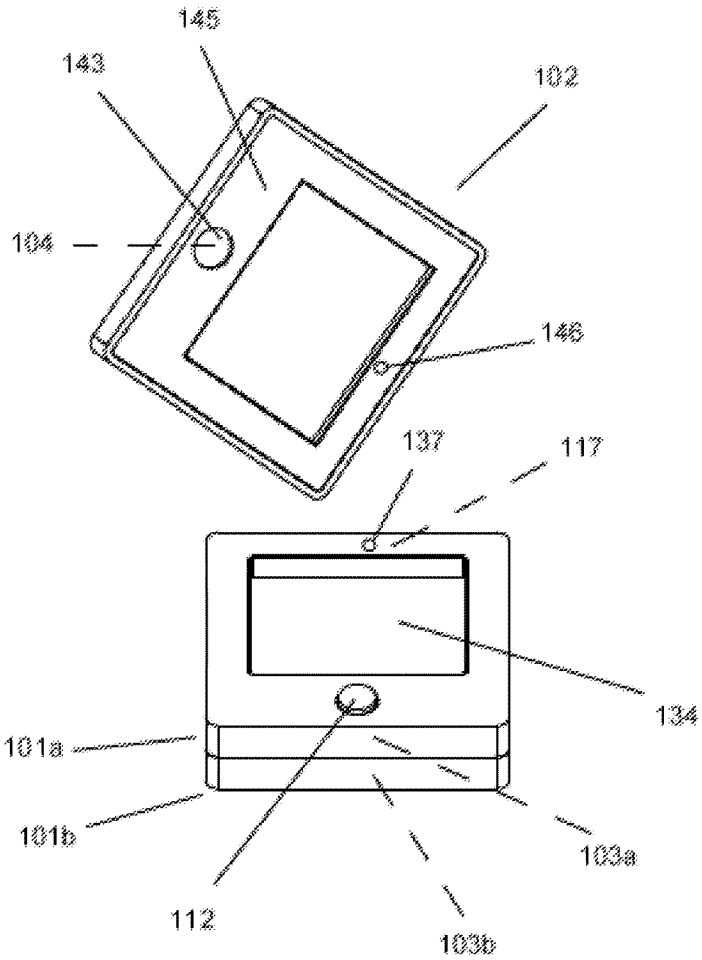
FIGS. 9*a*-9*c* shows how the cover and multiple bases are magnetically attached to one another creating a modular container.
Figure 9B:
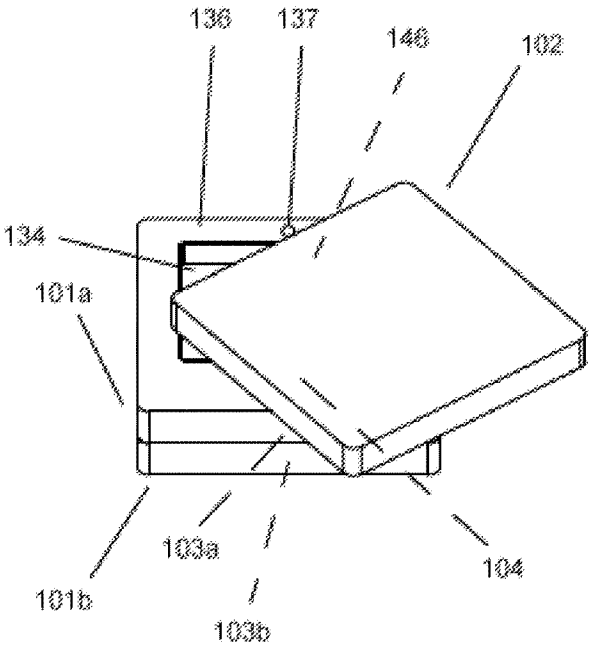
Figure 9A:
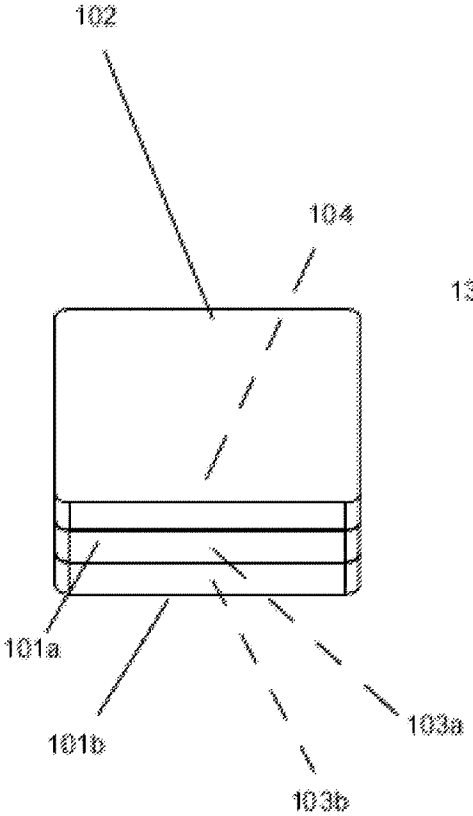
Figure 10:
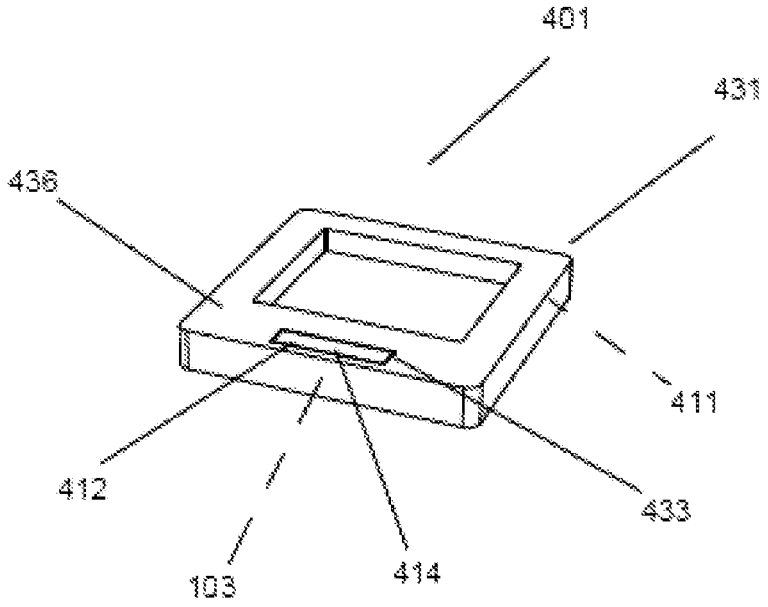
FIG. 10 shows a magnetic configuration of the container where the button is flush with the top surface of the upper base.
Figure 11:
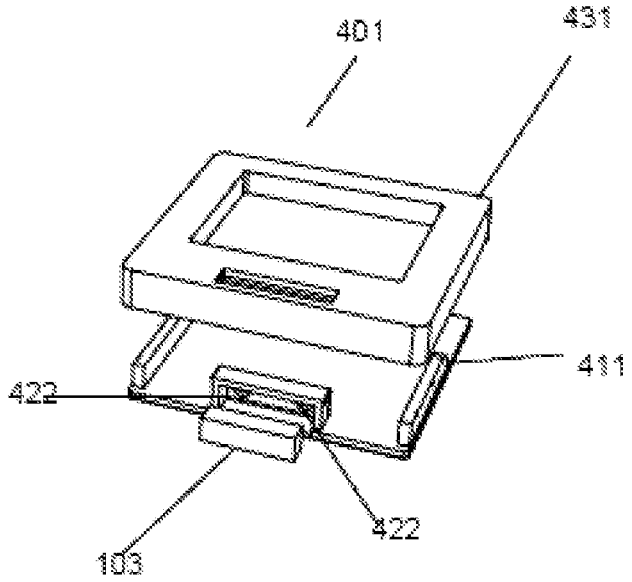
FIG. 11 show how the magnet can be removed laterally via access holes.

9 a-c show how, in the exemplary device, individual container components described above, comprising bases and a cover, may be opened and separated from one another. This illustration shows a device with two bases and one cover. FIG. 9*a* shows the device elements completely closed. The first base 101*a*, second base 101*b*, and cover are magnetically held together by three embedded, coaxial magnets respectively, 103*a*, 103*b*, and 104.

9b shows the cover as it rotates about the common axis of the first base magnet 103*a* and cover magnet 104. The function of the magnets is to prevent the cover and bases from separating at their contact points. The rotation is allowed by the opposing magnets of the cover and bases if the contact between the coaxial contact points is substantially maintained. Initially, the cover and the first base 101*a* are mechanically prevented from rotating because of an upper base protrusion 137 which, when engaged with the cover indent 146 as described in FIG. 2, prevent the first base and cover from rotating relative to one another without an intentional force exerted by the user. The resulting rotational relative movement experienced between the cover 102 and first base 101*a* shown in FIG. 9*b* results when a sufficient force vector causes the cover indent to be dislodged from the upper base protrusion and rotate around the common axes of the first base magnet 103*a* and the cover magnet 104. The upper base product well 134 is shown exposed when the cover is thus rotated.

9c shows a top view of the bases and a bottom view of the cover. The cover 102 is completely separated from the first base 1010*a* when sufficient force is used to separate the cover and base magnets. The magnets within the first and second bases may be rotated and separated in a similar manner. The position of the upper base protrusion 137 and the cover indent 146 are clearly shown in this figure.

10 shows the flush base 401 of the magnetic version with a flush button 412, whose flush button top surface 414 is flush with the upper base top surface 436 as it protrudes through the upper base button hole 433 of the upper base 431. The flush button in this case is rectangular in shape. Embedded beneath the button is a base magnet 103 which would engage with a corresponding cover magnet. The process for detaching and reattaching the upper base from the lower base 411 is the same as described in FIGS. 5-7.

The following figures describe the nonmagnetic version of the invention. In this case, instead of a magnet positioned below the button, the connection between a base and a cover, or between two bases is via a mechanical snap located on the button. The method for replacing the refillable portion is the same. The user pushes the button through a buttonhole and replaces the refillable portion.

Figure 12:
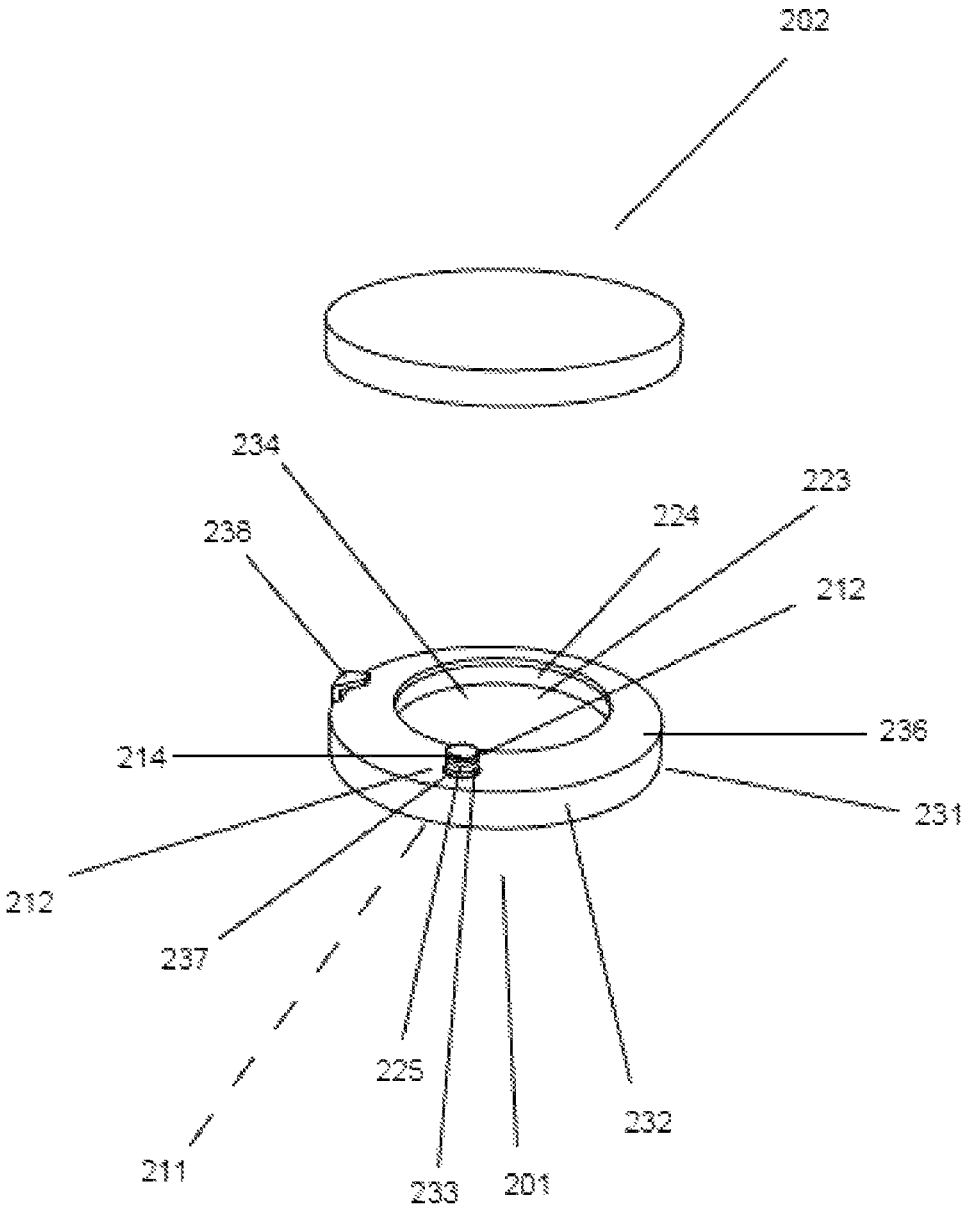
FIGS. 12-15 show the component parts of the nonmagnetic version of the refillable container.

FIG. 12 shows an exemplary design of the nonmagnetic version of the refillable container viewed obliquely from above. There is a cover 202, which will be detailed further below. The base 201 is composed of an upper base 231 and a lower base 211. The upper base has an upper base top surface 236 and is surrounded by upper base side walls 232. There is an upper base buttonhole 233, through which extends a button 212, which is attached to the lower base. The button has a button top surface 214. The device shows a base with two types of snap components which will be detailed below.

The base male connector 225 is located just below the button top surface. This will be configured to snap into a corresponding female lock in the bottom surface of the cover or base and will be detailed later. There is a latch 238 which will engage a cover or base latch opening and will be detailed later. The latch prevents the cover from rotating about the lower base button without an intentional applied force applied by the user.

There is a lower base product well 223 and surrounded by lower base product side walls 224, within which would be inserted a product. The well is located directly below the upper base product opening 234 through which a product can be accessed.

Figure 13:
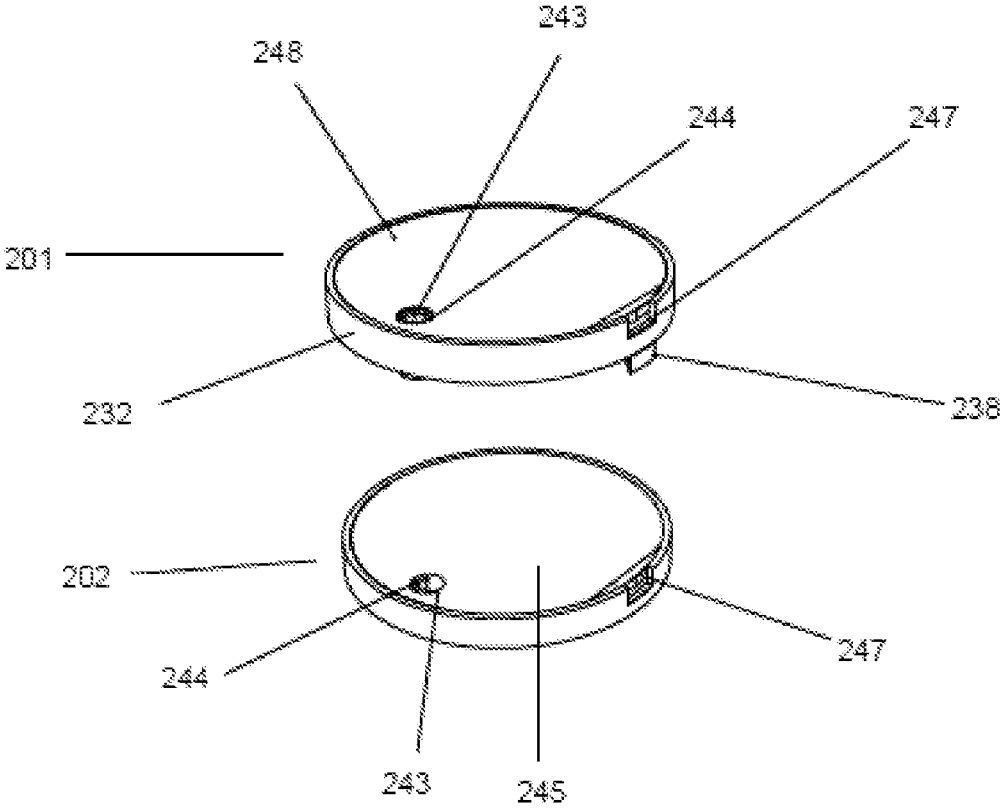

FIG. 13 shows oblique bottom views of the cover 202 and base 201 introduced in FIG. 12. On the bottom of the cover is a cover bottom surface 245. Protruding through the cover bottom surface is a hole 243 within which is positioned a female lock 244. This lock might be a form of snap or a protrusion. The dimensions are configured such that when the male connector 225 described in FIG. 12, engages the female lock, the cover and base form a snap fit that prevents these components from being separated without the user intentionally pulling them apart.

Similarly, a second base may snap into the first base. A similar hole and female lock can be designed into the bottom lower base bottom surface 218 such that the two bases can not be separated without intentional force.

There is a latch lock 247 built into the side of the cover. This configured so that when the male connector is snapped into the female lock located in the cover's hole, and the cover rotates over the base thus covering the product well, the latch 238 engages the latch lock thereby preventing the cover from rotating open again until an intentional force is administered.

Likewise, a latch lock can be built into the upper base side wall 232 configured so that the described latch can similarly engage with it when one base is rotated closed over a second base.

Figure 14:
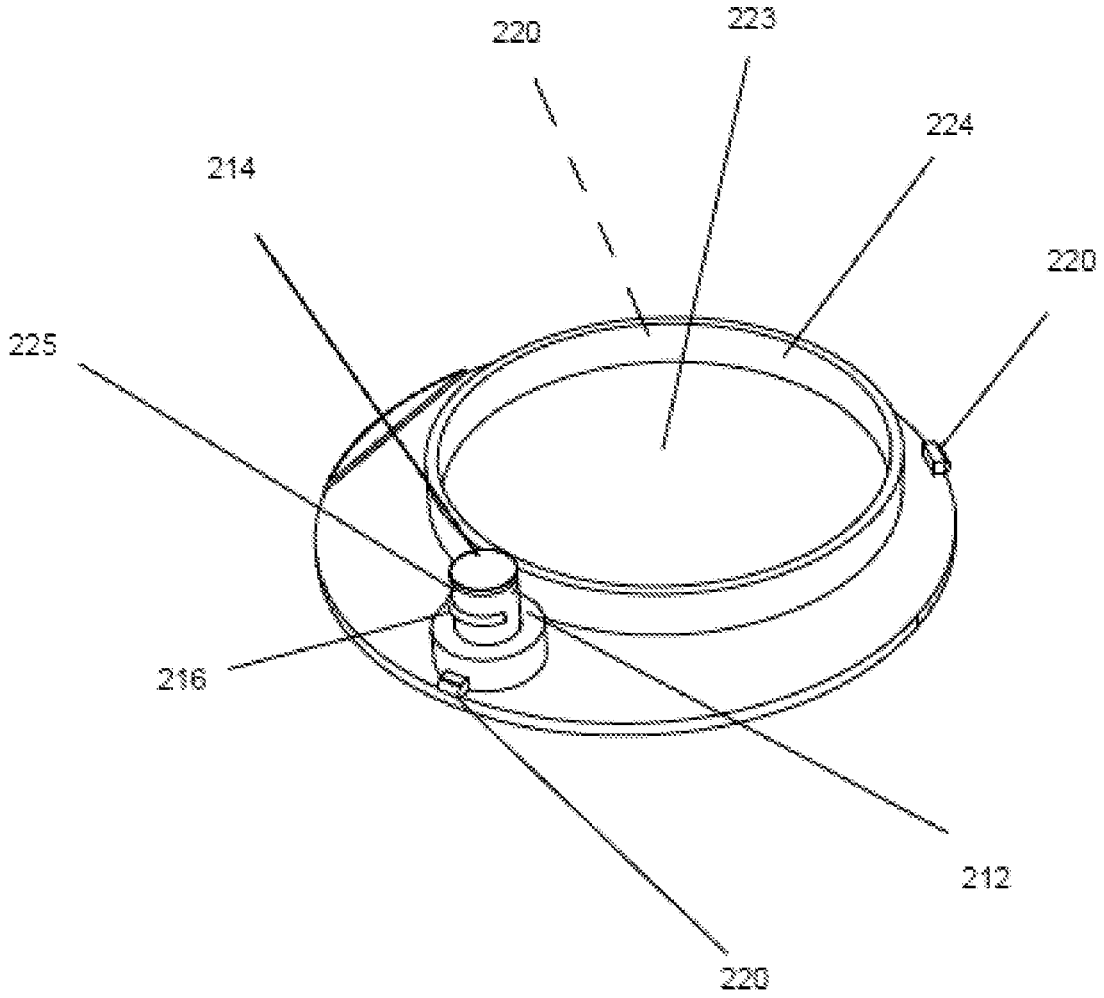
Figure 15:
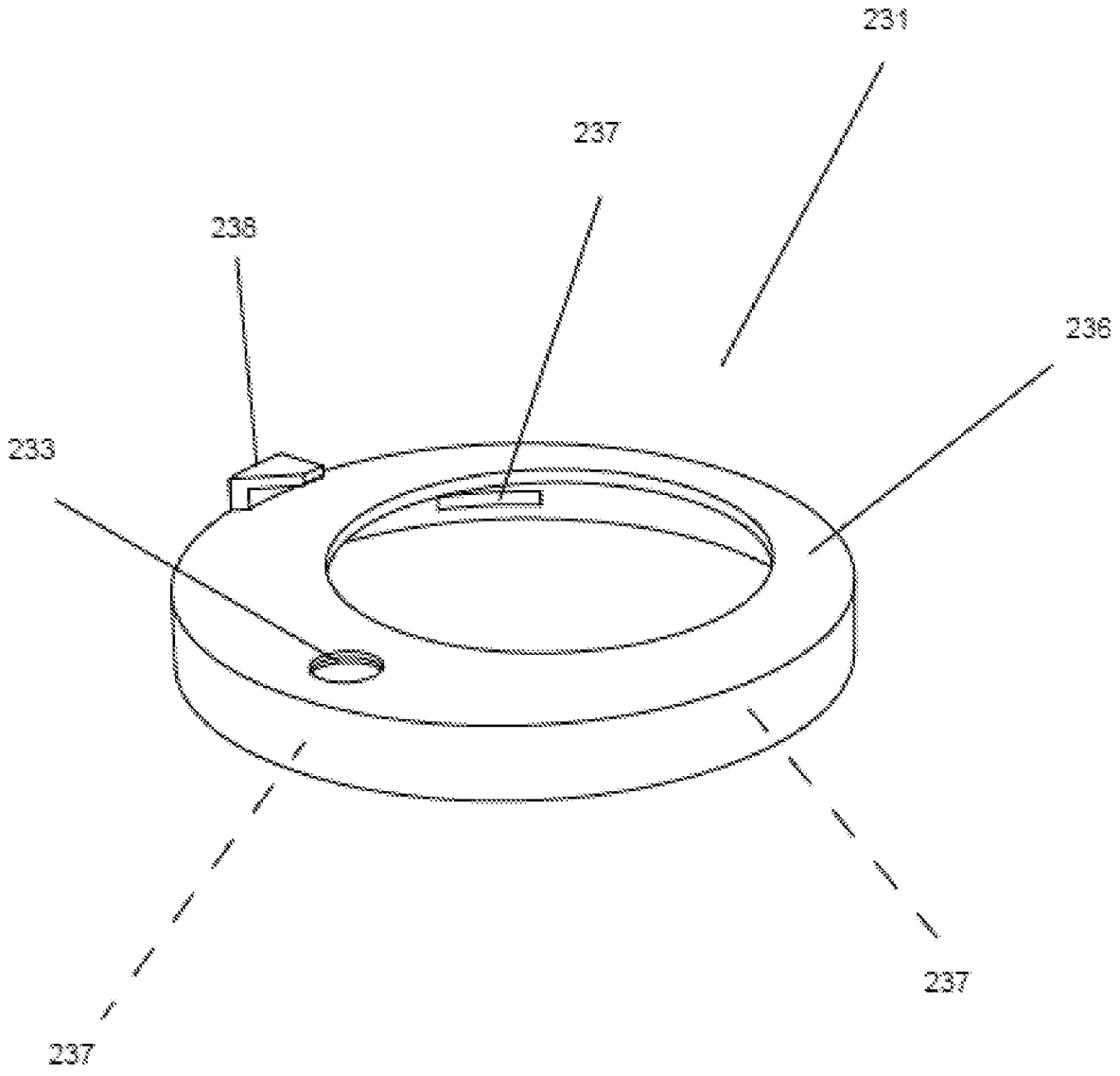

FIG. 14 shows the lower base 211 with a lower base product well 223 surrounded by lower base product side walls 224. There is a button 212 extending upwards and positioned such that it will penetrate the upper base buttonhole 233 as shown in FIG. 15. Also shown is the button top surface 214, below which is the male connector 225. Below the male connector on the button side surface 215, is a button snap 216.

There are multiple lower base snap components 220 designed and positioned so that they will engage with corresponding upper base snap components shown in FIG. 15, when the lower base is attached to the upper base. This is described further in FIG. 16.

FIG. 15 shows the upper base 231. There is an upper base buttonhole 233. Inside the upper base are the upper base snap components 237. The lower base described in FIG. 14, and the upper base are designed and dimensioned so that when the lower base is attached to the upper base, the button penetrates the upper base buttonhole such that the button snap is forced through the hole and engages with the upper base top surface 236. The lower base can not separate from the upper base unless sufficient force is exerted onto the button top surface, disengaging the button snap and the lower base snap components respectively from the corresponding upper base top surface, and upper base snap components.

Figure 16C:
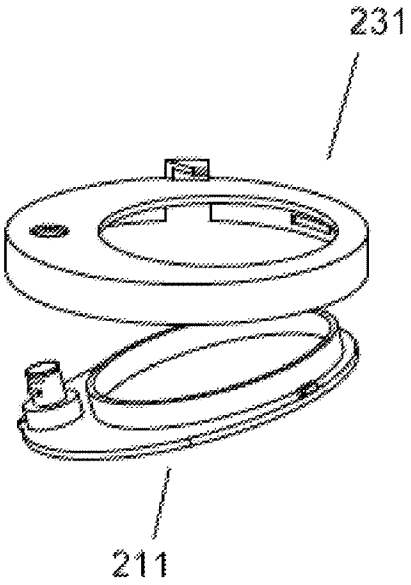
FIGS. 16*a*-16*c* show a sequence illustrating how the lower portion of the base is disengaged from the upper portion of the base.
Figure 16B:
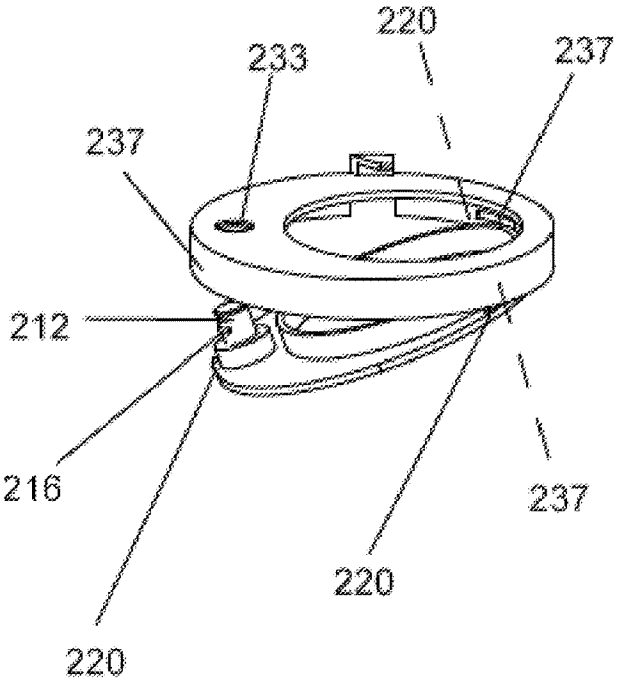
Figure 16A:
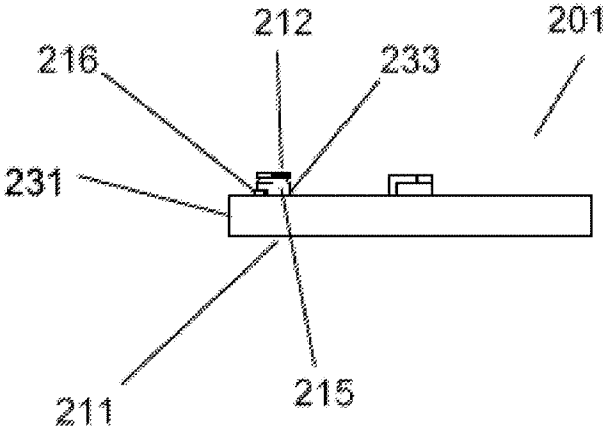

FIGS. 16*a-c* illustrate how the lower base 211 is disconnected from the upper base 231. The process is similar to that shown in FIGS. 5-7. The primary different is the addition of the interaction between the button snap and 216 and the upper base top surface.

FIG. 16*a* is a side view showing the outside of the base with the upper base and lower base attached together. Though not shown, it is assumed that the upper and lower base snap components are engaged. In addition, the button snap 216, located on the button side surface 215, has penetrated through the upper base buttonhole 233, and engages with and rests just above the upper base top surface. The width of the button snap is slightly larger than the diameter of the upper base buttonhole. Therefore, the lower base is locked to the upper base. When a user wants to separate the lower base containing product, from the upper base, they need to apply sufficient pressure to the button relative to the lower base.

FIG. 16*b* shows how the button 212 of the lower base is pushed through the upper base buttonhole 233 in the upper base. The lower base snap components 220 and upper base snap components 237 are dislodged, and the lower base's button snap component 216 is forced through the buttonhole. FIG. 16*c* shows how the lower and upper bases are completely separated.

The embodiments disclosed herein are examples of the disclosure and may be embodied in various forms. For instance, although certain embodiments herein are described as separate embodiments, each of the embodiments herein may be combined with one or more of the other embodiments herein. Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

The foregoing description is only illustrative of the present disclosure. Various alternatives and modifications can be devised by those skilled in the art without departing from the disclosure. Accordingly, the present disclosure is intended to embrace all such alternatives, modifications, and variances. The embodiments described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed is:

1. A modular container device comprising:

a first base comprising an upper first base and a lower first base, wherein:

the upper first base and the lower first base are detachable, a lower first base protrusion is affixed to a first surface of the lower first base, a lower first base hole is fixed within a second surface of the lower first base, wherein the lower first base hole extends into a portion of the lower first base protrusion, and an upper first base opening is fixed within a first surface of the upper first base, wherein the upper first base opening corresponds to the lower first base protrusion and is configured to receive at least a portion of the lower first base protrusion; and a second base comprising an upper second base and a lower second base, wherein:

the upper second base and the lower second base are detachable, a lower second base protrusion is affixed to a first surface of the lower second base, a lower second base hole is fixed within a second surface of the lower second base, wherein the lower second base hole extends into a portion of the lower second base protrusion, and an upper second base opening is fixed within a first surface of the upper second base, wherein the upper second base opening corresponds to the lower second base protrusion and is configured to receive at least a portion of the lower second base protrusion, wherein the lower second base hole of the second base is configured to receive at least a portion of the lower first base protrusion of the first base, wherein when the lower first base protrusion is received simultaneously by the upper first base opening and the lower second base hole, the first base is rotatable relative to the second base.

2. The modular container device of claim 1, wherein the first surface of the upper first base and the first surface of the upper second base are parallel.

3. The modular container device of claim 1, wherein the lower first base includes at least a first connecting portion;

and the upper first base includes at least a second connecting portion;

wherein the first connecting portion is configured to correspond to the second connecting portion, such that when the lower first base is attached to the upper first base, the first connecting portion receives the second connecting portion.

4. The modular container device of claim 1, wherein the lower first base includes multiple first connecting portions;

and the upper first base includes multiple second connecting portions;

wherein the first connecting portions are configured to correspond to the second connecting portions, such that when the lower first base is attached to the upper first base, the first connecting portions receive the corresponding second connecting portions.

5. The modular container device of claim 1 wherein the lower first base can contain a product.

6. The modular container device of claim 1 wherein the upper first base can contain a product.

7. The modular container device of claim 1 wherein the lower first base can be detached from the upper first base by exerting a force on the protrusion relative to the upper first base.

* * * * *